United States Patent [19]

Lamle

[11] Patent Number: 4,998,737

[45] Date of Patent: Mar. 12, 1991

[54] TWO-SIDED PLAYING PIECE GAME SET

[76] Inventor: Stewart M. Lamle, 505 E. 79th St., New York, N.Y. 10021

[21] Appl. No.: 398,172

[22] Filed: Aug. 23, 1989

[51] Int. Cl.[5] ..... A63F 1/00
[52] U.S. Cl. ..... 273/296; 273/292
[58] Field of Search ..... 273/292, 296, 293, 184

[56] References Cited

U.S. PATENT DOCUMENTS

| | | | |
|---|---|---|---|
| 3,831,945 | 8/1974 | Scherini | 273/148 |
| 4,257,611 | 3/1981 | Schmitz, Sr. | 273/293 |
| 4,355,812 | 10/1982 | McCullough | 273/248 |
| 4,428,582 | 1/1984 | Smith | 273/296 |
| 4,570,940 | 2/1986 | Lamle | 273/296 |
| 4,575,096 | 3/1986 | Lam | 273/296 |
| 4,741,540 | 5/1988 | Levine | 273/292 |

OTHER PUBLICATIONS

"One Card Poker", Scarne's Encyclopedia of Games, Harper and Row, New York, N.Y., First ed., p. 28.
"Lady Luck", Warren Weaver, 1963.

*Primary Examiner*—William H. Grieb
*Assistant Examiner*—Jessica J. Harrison

[57] ABSTRACT

A game set includes a plurality of individual pieces having game playing indicia on first and second opposite sides thereof to form an indicia combination. N forms of indicia are used on the pieces of the game set and each of the possible indicia combinations using the N forms of indicia occur twice in the game set except for twin indicia combinations in which the indicia on both sides of the game piece is the same. Each twin indicia combination of the N forms of indicia occur once in the game set. The total number of pieces in the game set is equal to $N^2$. A video version of the game is also disclosed.

8 Claims, 2 Drawing Sheets

TWO-SIDED PLAYING PIECE GAME SET

BACKGROUND OF THE INVENTION

This invention relates to a set of flat, stackable game pieces which may be used in playing a game and to a video apparatus which replicates the game playable with the game set.

Games which utilize flat, stackable game pieces are well known in the art. Such games usually comprise card or tile sets having indicia on one face thereof which are used in combination with other cards or tiles of the set. Because the indicia on each game piece is only on one side, the variety of games which may be played with such sets is limited; and the element of surprise which exists when indicia appears on both sides of the game pieces is absent.

The prior art patent to Lamle, U.S. Pat. No. 4,570,940, shows a domino game set in which playing indicia appears on both sides of the game set pieces Each piece in the game set displays an indicia combination which is unique in the set, and the total number of pieces in the set is equal to $(N)(N+1)/2$. When playing with the prior art Lamle game set, the unique indicia combination on each piece of the game set allows an attentive player to mentally note which game pieces have already been played and thus to speculate with a reasonable degree of accuracy which game pieces will be played next. This feature of the Lamle game set is a disadvantage when playing certain games, including games of chance. There is, therefore, a need in the art for a game set which avoids the above disadvantages. There is further a need for a video game apparatus which replicates the game set of the instant invention and the games which may be played therewith.

SUMMARY AND OBJECTS OF THE INVENTION

According to the invention, a game set is provided wherein the individual game pieces comprising the set display indicia on both sides thereof. The number of game pieces in the set is equal to $(N)N+1)/2+N(N-1)/2=N^2$; and each indicia combination occurs twice in the set, except for twin indicia combinations which occur only once.

It is, therefore, an object of the invention to provide a game set comprising game pieces which have indicia on both faces thereof.

It is another object of the invention to provide a game set in which certain of the indicia combinations occur more than once in the set.

It is another object of the invention to provide a video game apparatus which replicates the game set of the instant invention.

These and other objects of the invention will become apparent from the following detailed description taken in conjunction with the accompanying drawing figures in which reference numerals used throughout the description designate like or corresponding parts on the drawings.

DESCRIPTION OF THE PREFERRED EMBODIMENT

Figure 1:
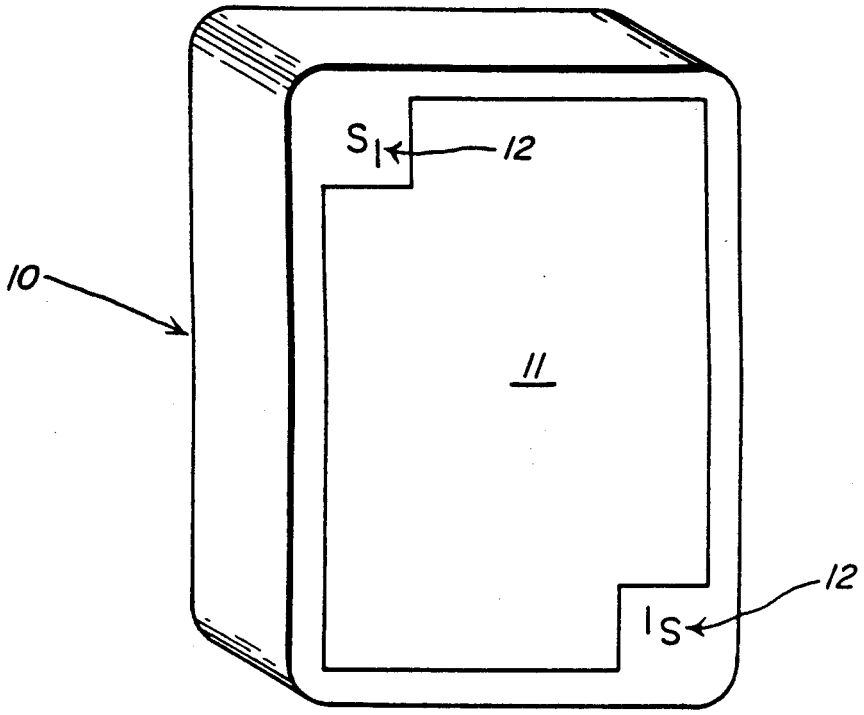
FIG. 1 shows the front face of a typical game piece in the tile game set of the invention.

Referring now to the drawing figures, there is shown in FIG. 1 a game piece generally designated by the reference numeral 10. The game piece is generally rectangular in shape and is flat and stackable for convenience of game play. The game piece may be formed from materials such as plastic, wood, stone, cardboard or the like. The game piece has a smooth surface and may be stained or painted, or left in a natural state as desired. The piece 10 comprises a front side 11, and the upper left- and the lower right-hand corner of each piece includes marking indicia 12. Such indicia 12 may comprise numbers, letters, symbols, or colors which allow the pieces to be distinguished one from the other. In a preferred embodiment, the symbols used on the pieces are the numbers 1, 2, 3, 4, 5, 6, 7, 8, 9, and 10.

Figure 2:
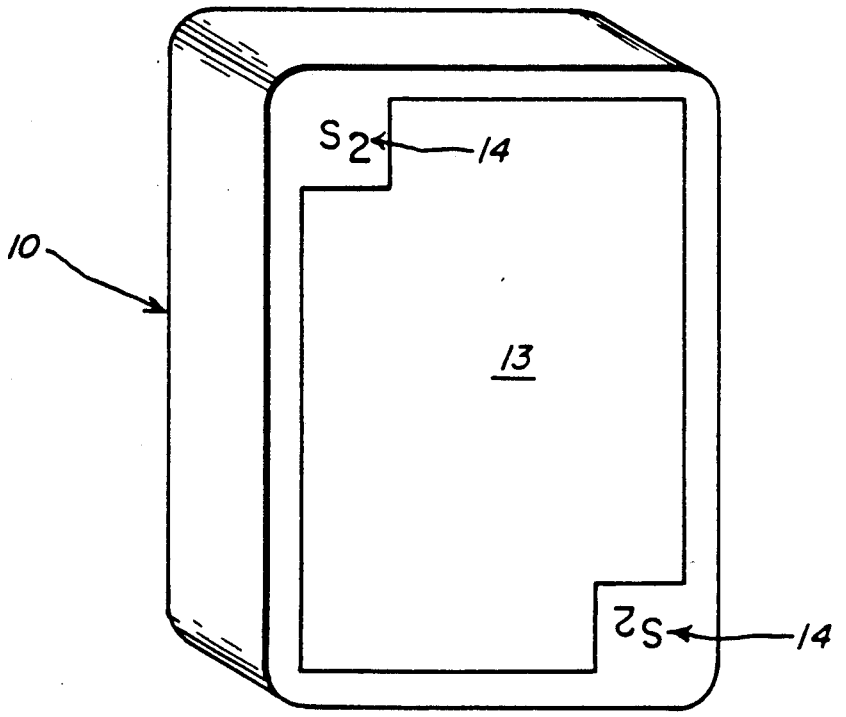
FIG. 2 shows the back of the game piece of FIG. 1.

FIG. 2 shows the reverse side 13 of the game piece of FIG. 1. Indicia 14 appears on the reverse side 13 of the piece, and this is located on the upper left- and lower right-hand corner. The indicia 14 may also comprise numbers or letters or symbols or the like but will be chosen from the same group of indicia comprising the indicia 12 on the front surface of the piece. Accordingly, in the preferred embodiment, the indicia 14 may comprise one of the following symbols: 1, 2, 3, 4, 5, 6, 7, 8, 9, and 10.

The indicia combinations on the front and the back surfaces of the game pieces are chosen so that each indicia combination occurs twice in the set except for twin indicia combinations which occur only once. A twin indicia combination is one in which the same indicia appears on both sides of the piece.

According to the preferred embodiment, a game set has N forms of indicia; and the total number of pieces in the set is equal to $(N)(N+1)/2+(N)(N-1)/2=N^2$. If N equals 10, the number of pieces in the set is equal to $(10)(11)/2+(10)(9)/2=55+45=100=N^2$.

The indicia combinations which occur in a set are shown in the following table:

| | | Front Side | | | | | | | | | |
|---|---|---|---|---|---|---|---|---|---|---|---|
| | | 1 | 2 | 3 | 4 | 5 | 6 | 7 | 8 | 9 | 10 |
| Reverse Side | 1 | 1/1 | 1/2 | 1/3 | 1/4 | 1/5 | 1/6 | 1/7 | 1/8 | 1/9 | 1/10 |
| | 2 | 2/1 | 2/2 | 2/3 | 2/4 | 2/5 | 2/6 | 2/7 | 2/8 | 2/9 | 2/10 |
| | 3 | 3/1 | 3/2 | 3/3 | 3/4 | 3/5 | 3/6 | 3/7 | 3/8 | 3/9 | 3/10 |
| | 4 | 4/1 | 4/2 | 4/3 | 4/4 | 4/5 | 4/6 | 4/7 | 4/8 | 4/9 | 4/10 |
| | 5 | 5/1 | 5/2 | 5/3 | 5/4 | 5/5 | 5/6 | 5/7 | 5/8 | 5/9 | 5/10 |
| | 6 | 6/1 | 6/2 | 6/3 | 6/4 | 6/5 | 6/6 | 6/7 | 6/8 | 6/9 | 6/10 |
| | 7 | 7/1 | 7/2 | 7/3 | 7/4 | 7/5 | 7/6 | 7/7 | 7/8 | 7/9 | 7/10 |
| | 8 | 8/1 | 8/2 | 8/3 | 8/4 | 8/5 | 8/6 | 8/7 | 8/8 | 8/9 | 8/10 |
| | 9 | 9/1 | 9/2 | 9/3 | 9/4 | 9/5 | 9/6 | 9/7 | 9/8 | 9/9 | 9/10 |
| | 10 | 10/1 | 10/2 | 10/3 | 10/4 | 10/5 | 10/6 | 10/7 | 10/8 | 10/9 | 10/10 |

An inspection of the table shows that the twin indicia combination such as 1/1, 2/2, etc., occur only once, while all of the other indicia combinations each occur twice. Each indicia in the deck occurs 2N times.

METHOD OF USE OF THE PREFERRED EMBODIMENT

As an example only, the following game may be played using the game set described above. The object of the game is to guess which of two cards has the higher value on the bottom face. There are three possibilities: Card "A", Card "B", or a Tie.

The dealer deals two cards to the table from the card stack without revealing the bottom faces of the cards. The card stack may comprise several decks which have been shuffled together into a single stack. The players each place a bet in front of the card which they believe has a higher value on the other side, several players may bet on the same card. The players place a bet between the cards if they believe both cards have the same value on the other side.

Bets can be placed until the dealer calls "All Bets Down".

After the dealer calls "All Bets Down", the dealer turns the two cards over to show the bottom face of each card. The dealer collects the loosing bets and pays the winning bets. When a portion of the stack has been used, the entire stack is shuffled both in the normal way and in a way which mixes the top faces with the bottom faces.

Figure 3:
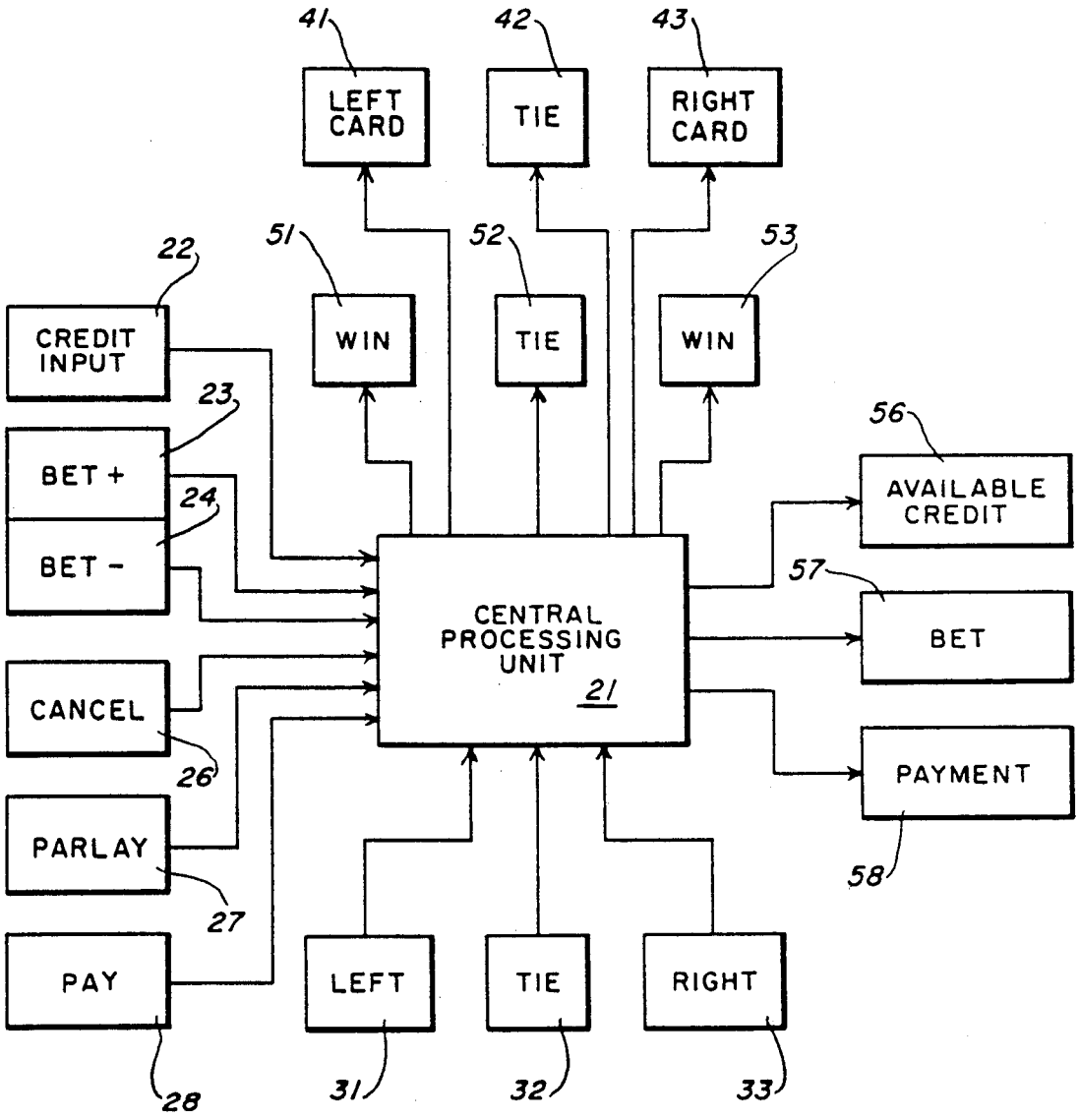
FIG. 3 is a schematic diagram of a video version of the game set of FIGS. 1 and 2.

FIG. 3 is a schematic diagram showing a video version of the game set and method of playing a game therewith. The apparatus of FIG. 3 is controlled by a central processing unit 21 which is programmed with the front and back face values of a plurality of card decks which have been shuffled into a random order. Input signals to the central processing unit 21 come from a Credit Input 22, a Bet + (addition) button 23, a Bet − (substraction) button 24, a Cancel button 26, a Parlay button 27, and a Pay button 28. The central processing unit also receives inputs from the Left button 31, the Tie button 32, and the Right button 33 as explained more fully below. The central processing unit controls the display on a Left Card video screen 41, a Tie indicator 42, and a Right Card video screen 43. The central processing unit also controls the illumination of two Win lights 51 and 53 and a Tie light 52 as well as an Available Credit indicator 56, and a Bet indicator 57, and payout to a Payment cup 58.

The apparatus of FIG. 3 is used in the following way. A player establishes credit with the apparatus by means of the Credit Input 22, and the total amount inserted is displayed on the Available Credit display 56. The Credit Input 22 may be designed to accept a variety of credit forms such as coins, tokens, smart credit cards, or hypothetical credit which is input by the keyboard of a home video unit. The central processing unit 21 then displays a Left Card on the Left screen 41 and a Right Card on the Right screen 43. The central processing unit 21 may set an original bet at one or five units (assuming the Credit 56 shows a credit of at least 5) or some other number of units, and the player may use the Bet + button 23 or the Bet - button 24 to increase or decrease the bet. The player then presses either the Left button 31 or the Right button 32 to bet that either the Left Card or the Right Card respectively will be higher in value when turned over to reveal the other side. The player may also press the Tie button 32 to bet that values of the Left Card 41 and the Right Card 43 will be the same when turned over. In response to placement of the bet, the Left Card 41 or the Right Card 43 display is intensified; and in the event that a Tie bet has been place, the Tie indicating lamp 42 is illuminated. In the event that the player does not wish to bet on the two cards which are displayed, the Cancel button 26 may be pushed to display two new cards on the Left Card display 41 and the Right Card display 43. Once the bet has been placed, the screens 41 and 43 show the left and right cards turning to reveal the other faces of the cards. The highest of the two cards is highlighted in a manner which is different from the method of highlight used to indicate the bet; and if the player has bet correctly, the appropriate Win lamp 51 or 53 is illuminated. In the event that the cards shown on the left and the right video screens are of equal value and the player has bet on a tie, the Tie lamp 52 will be illuminated.

When the player wins, the amount won will be added to the amount shown on the Available Credit display 56, and may be parlayed into the next round betting by means of the Parlay button 27. Play continues until the player depresses the Pay button 28 to receive the amount shown on the Available Credit display 56 or until the amount shown on the Available Credit display 56 and the Bet display 57 are both equal to zero. Winnings are distributed to the player at the Payment cup 58.

Having thus described the invention, various alterations and modifications thereof will occur to those skilled in the art. For example, other indicia and other numbers of indicia may be used. In each of these forms, the indicia appearing on opposite sides of the game pieces will be varied as described above, enabling similar type games to be played as with the preferred embodiment.

Other alterations and modifications will occur to those skilled in the art, which alterations and modifications are intended to be within the scope of the invention as defined by the appended claims.

What I claim is:

1. A game set comprising a plurality of individual pieces having game playing indicia on first and second opposite sides thereof to form an indicia combination, where N forms of indicia are used on the pieces of the game set and N is equal to or greater than 3, wherein each of the possible indicia combinations using the N forms of indicia occur twice in the game set except for twin indicia combinations in which the indicia on both sides of the game piece is the same, each twin indicia combination of the N forms of indicia occurring once in the game set.

2. The game set of claim 1 wherein the number of pieces having a twin indicia combination thereon is N.

3. The game set of claim 2 wherein the total number of pieces in the game set equals $N^2$.

4. The game set of claim 3 wherein each indicia occurs in the deck 2N times.

5. A game set comprising a plurality of individual pieces having game playing indicia on first and second sides thereof to form an indicia combination where N forms of indicia are used on the pieces of the game set and N is equal to or greater than three wherein the pieces of the game set are defined as the sum of:

(a) a first group of pieces wherein each piece in the first group displays an indicia combination which is unique in the first group and the total number of pieces in the first group is $(N)(N+1)/2$ ; and (b) a second group of pieces wherein each piece in the second group displays an indicia combination which is unique in the second group, there are no pieces in the second group which have the same indicia on both sides thereof, and the total number of pieces in the second group is $(N)(N-1)/2$.

6. The game set of claim 5 wherein all of the indicia combinations in the second group also appear in the first group.

7. The game set of claim 6 wherein N pieces of the first group have the same indicia on both sides thereof.

8. The game set of claim 7 wherein the total number of pieces in the set is equal to $N^2$.

* * * * *